US010641490B2

(12) United States Patent
Tangirala et al.

(10) Patent No.: US 10,641,490 B2
(45) Date of Patent: May 5, 2020

(54) COMBUSTOR FOR USE IN A TURBINE ENGINE

(71) Applicant: General Electric Company, Schenectady, NY (US)

(72) Inventors: Venkat Eswarlu Tangirala, Niskayuna, NY (US); Narendra Digamber Joshi, Guilderland, NY (US); Sarah Marie Monahan, Latham, NY (US)

(73) Assignee: General Electric Company, Schenectady, NY (US)

( * ) Notice: Subject to any disclaimer, the term of this patent is extended or adjusted under 35 U.S.C. 154(b) by 228 days.

(21) Appl. No.: 15/398,496

(22) Filed: Jan. 4, 2017

(65) Prior Publication Data

US 2018/0187888 A1 Jul. 5, 2018

(51) Int. Cl.

| | |
|---|---|
| ***F23R 3/00*** | (2006.01) |
| ***F23R 3/58*** | (2006.01) |
| ***F23R 3/06*** | (2006.01) |
| ***F23R 3/12*** | (2006.01) |
| ***F23R 3/02*** | (2006.01) |
| ***F23R 3/04*** | (2006.01) |
| ***F23R 3/42*** | (2006.01) |
| ***F23R 3/52*** | (2006.01) |

(52) U.S. Cl.

CPC ..... *F23R 3/002* (2013.01); *F23R 3/02* (2013.01); *F23R 3/04* (2013.01); *F23R 3/045* (2013.01); *F23R 3/06* (2013.01); *F23R 3/12* (2013.01); *F23R 3/42* (2013.01); *F23R 3/52* (2013.01); *F23R 3/58* (2013.01); *F23R 2900/03042* (2013.01)

(58) Field of Classification Search

CPC .... F23R 3/002; F23R 3/02; F23R 3/04; F23R 3/045; F23R 3/12; F23R 3/06; F23R 3/42; F23R 3/52; F23R 3/58; F23R 2900/00015; F23R 2900/03042

See application file for complete search history.

(56) References Cited

U.S. PATENT DOCUMENTS 4,702,073 A * 10/1987 Melconian ..... F23R 3/06 60/39.464

4,719,748 A 1/1988 Davis, Jr. et al.

(Continued)

OTHER PUBLICATIONS

Wei-Hua, Yang et al., "Experimental Investigation on Impingement-Effusion Film-Cooling Behaviors in Curve Section," Acta Astronautica, Science Direct, vol. 68, Issues 11-12, pp. 1782-1789, Jun.-Jul. 2011.

*Primary Examiner* — Scott J Walthour

(74) *Attorney, Agent, or Firm* — Armstrong Teasdale LLP

(57) ABSTRACT

A combustor for use in a turbine engine that includes an inner combustion liner and an outer combustion liner. An interior is defined between the inner combustion liner and the outer combustion liner, and the interior includes a cavity portion and a main portion extending radially inward from the cavity portion. The cavity portion includes a flow inlet and the main portion includes a flow outlet. A plurality of film cooling holes are formed in at least one of the inner combustion liner and the outer combustion liner. The plurality of film cooling holes are configured such that cooling airflow discharged therefrom flows helically relative to a centerline of the turbine engine and towards the flow outlet.

17 Claims, 3 Drawing Sheets

(56) References Cited

U.S. PATENT DOCUMENTS

| | | | | |
|---|---|---|---|---|
| 5,025,622 | A * | 6/1991 | Melconian | F23R 3/425 60/39.464 |
| 6,951,108 | B2 | 10/2005 | Burrus et al. | |
| 6,955,053 | B1 * | 10/2005 | Chen | F23R 3/06 60/752 |
| 7,493,767 | B2 | 2/2009 | Bunker et al. | |
| 7,628,020 | B2 | 12/2009 | Alkabie et al. | |
| 8,720,257 | B2 | 5/2014 | Krull et al. | |
| 8,794,006 | B2 | 8/2014 | Chokshi et al. | |
| 8,887,508 | B2 | 11/2014 | Brown et al. | |
| 9,052,114 | B1 * | 6/2015 | Toqan | F23R 3/286 |
| 2006/0042263 | A1 * | 3/2006 | Patel | F23R 3/06 60/776 |
| 2012/0324898 | A1 | 12/2012 | McMahan et al. | |
| 2013/0318986 | A1 | 12/2013 | Kraemer | |

* cited by examiner

COMBUSTOR FOR USE IN A TURBINE ENGINE

BACKGROUND

The present disclosure relates generally to turbine engines and, more specifically, to a tangential radial inflow combustor assembly having a multihole cooling arrangement that preserves the angular momentum of bulk swirl airflow channeled therethrough.

Rotary machines, such as gas turbines, are often used to generate power with electric generators. Gas turbines, for example, have a gas path that typically includes, in serial-flow relationship, an air intake, a compressor, a combustor, a turbine, and a gas outlet. Compressor and turbine sections include at least one row of circumferentially-spaced rotating buckets or blades coupled within a housing. At least some known turbine engines are used in cogeneration facilities and power plants. Engines used in such applications may have high specific work and power per unit mass flow requirements.

In at least some known gas turbines, a first set of guide vanes is coupled between an outlet of the compressor and an inlet of the combustor. The first set of guide vanes facilitates reducing swirl (i.e., removing bulk swirl) of a flow of air discharged from the compressor such that the flow of air is channeled in a substantially axial direction towards the combustor. A second set of guide vanes is coupled between an outlet of the combustor and an inlet of the turbine. The second set of guide vanes facilitates increasing swirl (i.e., reintroducing bulk swirl) of a flow of combustion gas discharged from the combustor such that flow angle requirements for the inlet of the turbine are satisfied. However, redirecting the flows of air and combustion gas with the first and second sets of guide vanes increases operating inefficiencies of the gas turbine. Moreover, including additional components, such as the first and second sets of guide vanes generally adds weight, cost, and complexity to the gas turbine.

BRIEF DESCRIPTION

In one aspect, a combustor for use in a turbine engine is provided. The combustor includes an inner combustion liner and an outer combustion liner. An interior is defined between the inner combustion liner and the outer combustion liner, and the interior includes a cavity portion and a main portion extending radially inward from the cavity portion. The cavity portion includes a flow inlet and the main portion includes a flow outlet. A plurality of film cooling holes are formed in at least one of the inner combustion liner and the outer combustion liner. The plurality of film cooling holes are configured such that cooling airflow discharged therefrom flows helically relative to a centerline of the turbine engine and towards the flow outlet.

In another aspect, a turbine engine is provided. The turbine engine includes a compressor assembly configured to discharge compressed air therefrom and a combustor coupled in flow communication with the compressor assembly configured to receive the compressed air. The combustor includes an inner combustion liner and an outer combustion liner. An interior is defined between the inner combustion liner and the outer combustion liner, and the interior includes a cavity portion and a main portion extending radially inward from the cavity portion. The cavity portion includes a flow inlet and the main portion includes a flow outlet. A plurality of film cooling holes are formed in at least one of the inner combustion liner and the outer combustion liner. The plurality of film cooling holes are configured such that cooling airflow discharged therefrom flows helically relative to a centerline of the turbine engine and towards the flow outlet.

DRAWINGS

These and other features, aspects, and advantages of the present disclosure will become better understood when the following detailed description is read with reference to the accompanying drawings in which like characters represent like parts throughout the drawings, wherein.

Figure 1:
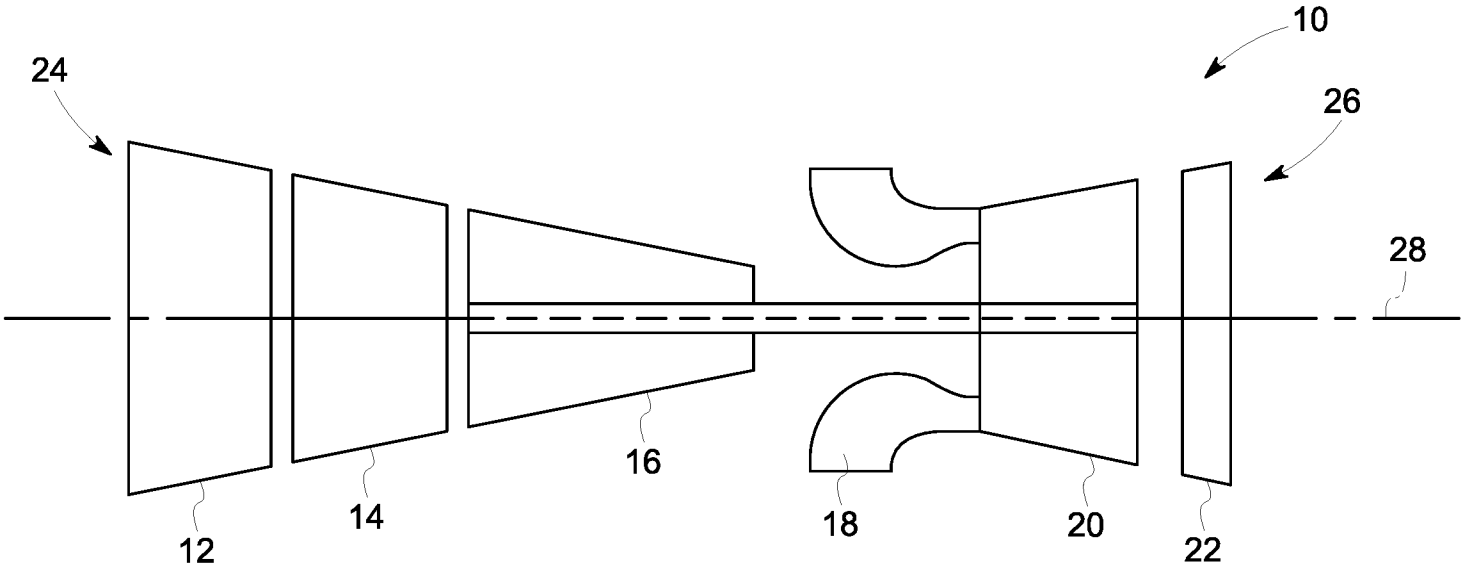
FIG. 1 is a schematic illustration of an exemplary turbine engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Embodiments of the present disclosure relate to a high-G, ultra-compact combustor including tangential radial inflow (TRI) combustors having a multihole cooling arrangement that preserves the angular momentum of bulk swirl airflow channeled therethrough. More specifically, the combustor includes an inner combustion liner and an outer combustion liner positioned such that an interior combustion chamber is defined therebetween. The liners are contoured such that the interior combustion chamber includes a cavity portion and a main portion extending radially inward from the cavity portion. Cavity airflow discharged into the cavity portion has a predetermined angular momentum, thereby defining the bulk swirl airflow. In addition, a plurality of holes, such as film cooling holes and dilution holes, are formed in the liners. The plurality of holes are formed such that airflow discharged therefrom into the interior combustion chamber does not disrupt the angular momentum of the bulk swirl airflow. As such, flow angle requirements for the turbine downstream from the combustor are maintained, thereby enabling the size of a nozzle positioned at an outlet of the combustor to be reduced. Moreover, reducing the size of the nozzle likewise reduces cooling flow requirements for the nozzle such that turbine efficiency is increased.

FIG. 1 is a schematic illustration of an exemplary turbine engine 10 including a fan assembly 12, a low-pressure or booster compressor assembly 14, a high-pressure compressor assembly 16, and a combustor assembly 18. Fan assembly 12, booster compressor assembly 14, high-pressure compressor assembly 16, and combustor assembly 18 are coupled in flow communication. Turbine engine 10 also includes a high-pressure turbine assembly 20 coupled in flow communication with combustor assembly 18 and a low-pressure turbine assembly 22. Turbine engine 10 has an intake 24 and an exhaust 26. Turbine engine 10 further includes a centerline 28 about which fan assembly 12, booster compressor assembly 14, high-pressure compressor assembly 16, and turbine assemblies 20 and 22 rotate.

In operation, air entering turbine engine 10 through intake 24 is channeled through fan assembly 12 towards booster compressor assembly 14. Compressed air is discharged from booster compressor assembly 14 towards high-pressure compressor assembly 16. Highly compressed air is channeled from high-pressure compressor assembly 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbine engine 10 via exhaust 26.

Figure 2:
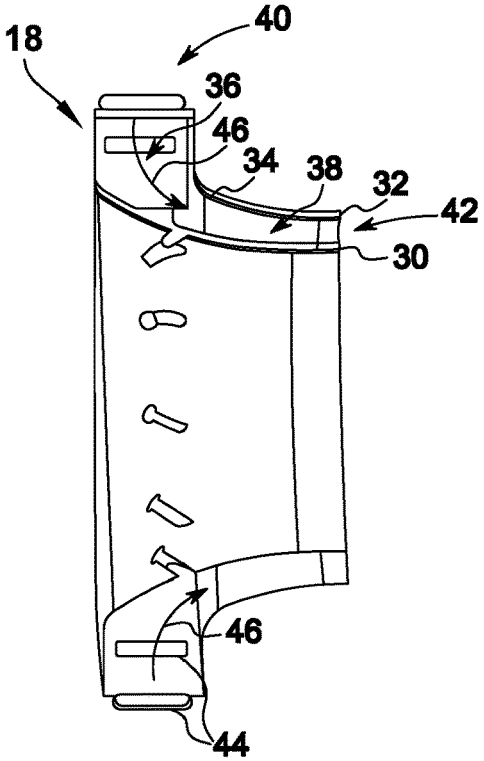
FIG. 2 is a cross-sectional view of an exemplary combustor that may be used in the gas turbine engine shown in FIG. 1.

FIG. 2 is a cross-sectional view of an exemplary combustor 18 that may be used in gas turbine engine 10 (shown in FIG. 1). In the exemplary embodiment, combustor 18 includes an inner combustion liner 30 and an outer combustion liner 32. An interior 34 is defined between inner combustion liner 30 and outer combustion liner 32, and includes a cavity portion 36 and a main portion 38 extending radially inward from cavity portion 36. In addition, cavity portion 36 includes a flow inlet 40 and main portion 38 includes a flow outlet 42. Flow inlet 40 includes a plurality of cavity inlet holes 44 that discharge cavity airflow 46 therefrom.

As described above, embodiments of the present disclosure relate to a high-G, ultra-compact, or tangential radial inflow (TRI) combustor. More specifically, inner combustion liner 30 and outer combustion liner 32 are convex relative to centerline 28 of turbine engine 10 such that cavity portion 36 and flow inlet 40 are defined at the radially outermost region of combustor 18. To facilitate inducing bulk swirl in cavity airflow 46, cavity inlet holes 44 are oriented such that cavity airflow 46 is discharged circumferentially and radially into cavity portion 36. As such, cavity airflow 46 flows from flow inlet 40 towards flow outlet 42 with a predetermined angular momentum (i.e., bulk swirl) selected to facilitate matching flow angle requirements for airflow entering turbine 20 (shown in FIG. 1). Moreover, cavity inlet holes 44 have any shape that enables combustor 18 to function as described herein. As shown, cavity inlet holes 44 are elongated slots that extend axially relative to centerline 28. Alternatively, cavity inlet holes 44 are circular openings.

Figure 3:
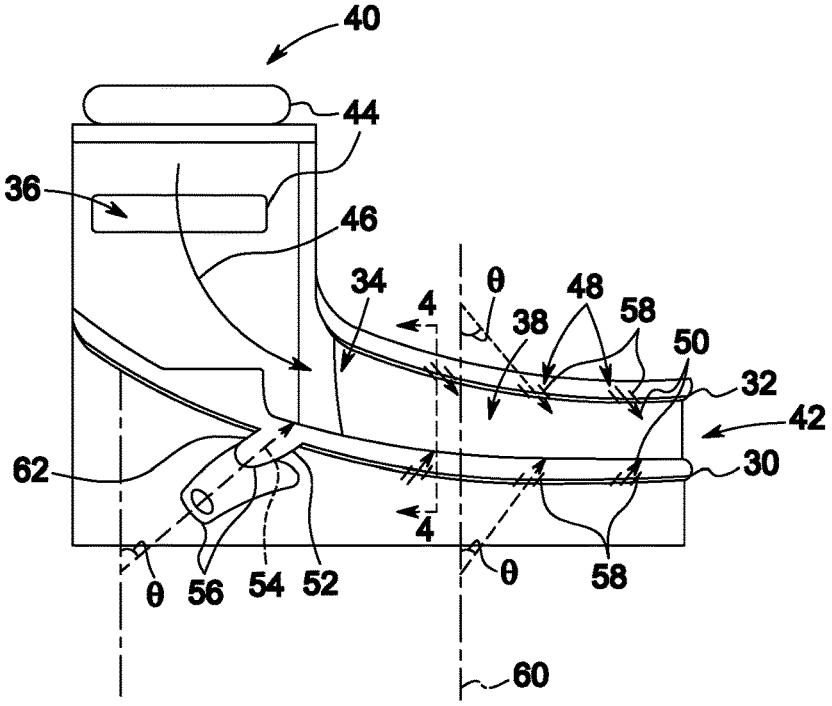
FIG. 3 is an enlarged view of a portion of the combustor shown in FIG. 2.

FIG. 3 is an enlarged view of a portion of combustor 18. In the exemplary embodiment, a plurality of film cooling holes 48 are formed in at least one of inner combustion liner 30 and outer combustion liner 32. The plurality of film cooling holes 48 are configured such that cooling airflow 50 discharged therefrom flows helically relative to centerline 28 (shown in FIG. 2) of turbine engine 10 (shown in FIG. 1) and towards flow outlet 42. As described above, cavity airflow 46 flows from flow inlet 40 towards flow outlet 42 with a predetermined angular momentum. The plurality of film cooling holes 48 discharge cooling airflow 50 therefrom such that the predetermined angular momentum of cavity airflow 46 is maintained when cooling airflow 50 mixes with cavity airflow 46. Put another way, cooling airflow 50 is discharged in such a way that does not disrupt the angular momentum of cavity airflow 46, thereby facilitating compliance with the flow angle requirements of turbine 20 (shown in FIG. 1).

In addition, a plurality of dilution holes 52 are formed in inner combustion liner 30. The plurality of dilution holes 52 discharge dilution airflow 54 therefrom at a greater flow rate than cooling airflow 50, and such that the fuel-air ratio within interior 34 is reduced. The plurality of dilution holes 52 are configured such that dilution airflow 54 discharged therefrom flows helically relative to centerline 28 of turbine engine 10. Similar to film cooling holes 48, the plurality of dilution holes 52 discharge dilution airflow 54 therefrom such that the predetermined angular momentum of cavity airflow 46 is maintained when dilution airflow 54 mixes with cavity airflow 46. Moreover, in the exemplary embodiment, each dilution hole 52 includes a chute 56 associated therewith and coupled to inner combustion liner 30. Chute 56 facilitates channeling airflow from a source (not shown) and through dilution holes 52. In an alternative embodiment, chutes 56 are omitted from combustor 18.

For example, in one embodiment, each film cooling hole 48 of the plurality of film cooling holes 48 comprises a flow channel 58 that extends through a thickness of at least one of inner combustion liner 30 and outer combustion liner 32 at an oblique angle Θ relative to a radial axis 60 of turbine engine 10. In addition, each dilution hole 52 of the plurality of dilution holes 52 comprises a flow channel 62 that extends through the thickness of inner combustion liner 30 at oblique angle Θ relative to radial axis 60 of turbine engine 10. More specifically, flow channels 58 and flow channels 62 are angled in an aftward axial direction relative to centerline 28 of turbine engine 10. As such, the downstream momentum of cavity airflow 46 is maintained when cooling airflow 50 and dilution airflow 54 mixes with cavity airflow 46 in interior 34.

Flow channels 58 and flow channels 62 are oriented at any angle relative to centerline 28 that enables combustor 18 to function as described herein. In one embodiment, the plurality of film cooling holes 48 and the plurality of dilution holes 52 are formed such that oblique angle Θ of flow channels 58 and flow channels 62 relative to radial axis 60 is greater than about 50 degrees.

Figure 4:
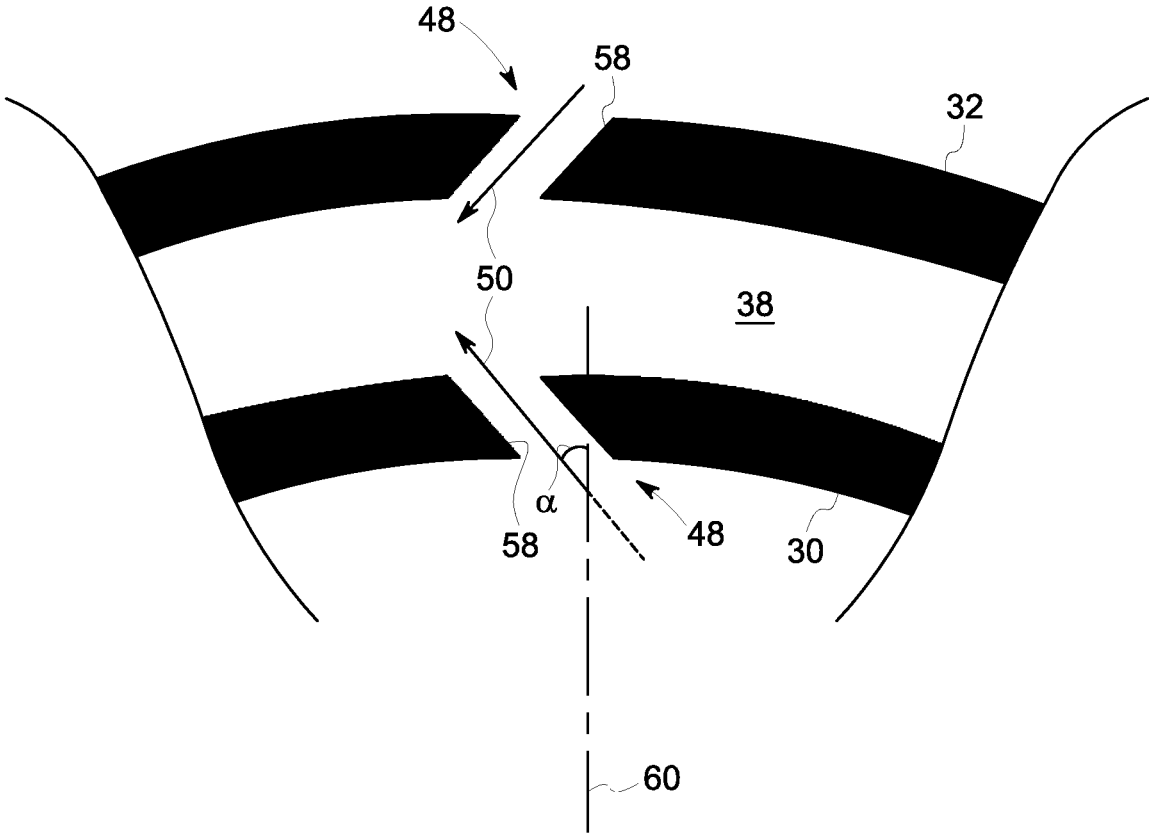
FIG. 4 is an axial view of a portion of the combustor shown in FIG. 3, taken along Line 4-4.

FIG. 4 is an axial view of a portion of combustor 18, taken along Line 4-4 (shown in FIG. 3). In the exemplary embodiment, each film cooling hole 48 of the plurality of film cooling holes 48 comprises flow channel 58 that extends through the thickness of at least one of inner combustion liner 30 and outer combustion liner 32 at an oblique angle a relative to radial axis 60 of turbine engine 10. More specifically, flow channel 58 is angled in a circumferential direction, in addition to the aftward axial direction, relative to centerline 28 of turbine engine 10 (shown in FIG. 1). As such, the predetermined angular momentum of cavity airflow 46 is maintained when cooling airflow 50 mixes with cavity airflow 46 and dilution airflow 54 in interior 34.

Flow channels 58 are oriented at any angle relative to centerline 28 that enables combustor 18 to function as described herein. In one embodiment, the plurality of film cooling holes 48 are formed such that oblique angle $\alpha$ of flow channels 58 relative to radial axis 60 is greater than about 50 degrees. In addition, while not shown in FIG. 4, flow channels 62 of the plurality of dilution holes 52 (each shown in FIG. 3) are oriented similarly to the plurality of film cooling holes 48 when viewed axially relative to centerline 28. As such, the predetermined angular momentum of cavity airflow 46 is likewise maintained when dilution airflow 54 (shown in FIG. 3) mixes with cavity airflow 46 in interior 34.

The combustor described herein implements a multihole film cooling and dilution hole arrangement that facilitates maintaining bulk swirl in the airflow channeled from the high-G cavity portion of the combustor. The holes are angled relative to a radial axis of the turbine engine in both the aftward axial and circumferential directions such that the airflow channeled therethrough flows helically relative to the centerline of the turbine engine. As such, tangential and downstream axial momentum of the cavity airflow is maintained, thereby facilitating compliance with flow angle requirements of the turbine coupled downstream from the combustor.

An exemplary technical effect of the apparatus and method described herein includes at least one of: (a) preserving the angular momentum of airflow channeled through a bulk swirl combustor; (b) reducing the size and/or cooling requirements for a stage one nozzle positioned between the combustor and the high-pressure turbine; and (c) facilitating a reduction in the weight and axial length of the turbine engine.

Exemplary embodiments of a turbine engine, and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only turbine assemblies and related methods as described herein. Rather, the exemplary embodiment can be implemented and utilized in connection with many applications where preserving bulk swirl is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A combustor for use in a turbine engine, said combustor comprising:

an inner combustion hner comprising a forward inlet end and an aftward outlet end;

an outer combustion liner comprising a forward inlet end and an aftward outlet end, said inner and outer combustion liners circumscribing a centerline extending through the combustor, wherein an interior is defined between said inner combustion liner and said outer combustion liner, said interior comprising a cavity portion and a main portion extending radially inward from said cavity portion, said cavity portion comprising a flow inlet defined at said forward inlet ends and said main portion comprising a flow outlet defined at said aftward outlet ends, said flow outlet positioned axially aftward from said flow inlet relative to the centerline, said flow inlet comprising a plurality of cavity inlet holes configured to discharge cavity airflow therefrom in an axially aftward and radially inward direction, relative to the centerline, to induce bulk swirl in the cavity airflow, wherein the cavity airflow is channeled from said flow inlet to said flow outlet with a predetermined angular momentum defined by the bulk swirl; and a plurality of film cooling holes formed in at least one of said inner combustion liner or said outer combustion liner, said plurality of film cooling holes configured such that cooling airflow discharged therefrom flows helically relative to the centerline and towards said flow outlet;

wherein said inner combustion liner comprises a converging cross-sectional shape from the forward inlet end of the inner combustion liner to the aftward outlet end of the inner combustion liner such that the converging cross-sectional shape of the inner combustion liner is convex, relative to the centerline, from the forward inlet end of the inner combustion liner to the aftward outlet end of the inner combustion liner, wherein said outer combustion lineer comprises a converging cross-sectional shape from the forward inlet end of the outer combustion liner to the aftward outlet end of the outer combustion liner such that the converging cross-sectional shape of the outer combustion liner is convex, relative to the centerline, from the forward inlet end of the outer combustion liner to the aftward outlet end of the outer combustion liner;

wherein the cavity portion is defined at a radially outermost region of the combustor and wherein the flow inlet is defined at the respective forward inlet end of the inner combustion liner and the forward inlet end of the outer combustion liner.

2. The combustor in accordance with claim 1, wherein each film cooling hole of said plurality of film cooling holes comprises a flow channel that extends through said at least one of said inner combustion liner or said outer combustion liner at an oblique angle relative to a radial axis oriented perpendicularly relative to the centerline.

3. The combustor in accordance with claim 2, wherein said flow channel is angled in a circumferential direction relative to the centerline.

4. The combustor in accordance with claim 2, wherein said flow channel is angled in an axial direction relative to the centerline.

5. The combustor in accordance with claim 2, wherein said plurality of film cooling holes are formed such that the oblique angle of said flow channel relative to the radial axis is greater than 50 degrees.

6. The combustor in accordance with claim 1, wherein said plurality of film cooling holes are configured to discharge the cooling airflow therefrom such that the predetermined angular momentum of the cavity airflow is maintained when the cooling airflow mixes with the cavity airflow, and wherein the cooling airflow is discharged so as to not disrupt the predetermined angular momentum of the cavity airflow.

7. The combustor in accordance with claim 1, further comprising a plurality of dilution holes formed in said inner combustion liner, said plurality of dilution holes configured such that dilution airflow discharged therefrom flows helically relative to the centerline, wherein each dilution hole of the plurality of dilution holes comprises a chute coupled to the inner combustor liner.

8. The combustor in accordance with claim 7, wherein said plurality of dilution holes are configured to discharge the dilution airflow therefrom such that the predetermined angular momentum of the cavity airflow is maintained when the dilution airflow mixes with the cavity airflow, and wherein each chute facilitates channeling airflow from at least one airflow source through each dilution hole.

9. A turbine engine comprising:

a compressor assembly configured to discharge cornpressed air therefrom; and a combustor coupled in flow communication with said compressor assembly configured to receive the compressed air, said combustor comprising:

an inner combustion liner comprising a forward inlet end and an aftward outlet end:

an outer combustion liner comprising a forward inlet end and an aftward outlet end, wherein an interior is defined between said inner combustion liner and said outer combustion liner, said interior comprising a cavity portion and a main portion extending radially inward from said cavity portion, said cavity portion comprising a flow inlet and said main portion comprising a flow outlet, said flow inlet and said flow outlet positioned at opposing ends of said combustor, and said flow outlet positioned axially aftward from said flow inlet relative to a centerline of the turbine engine, said flow inlet comprising a plurality of cavity inlet holes configured to discharge cavity airflow therefrom in an axially aftward and radially inward direction, relative to the centerline, to induce bulk swirl in the cavity airflow, wherein the cavity airflow is channeled from said flow inlet to said flow outlet with a predetermined angular momentum defined by the bulk swirl; and a plurality of film cooling holes formed in at least one of said inner combustion liner or said outer combustion liner, said plurality of film cooling holes configured such that cooling airflow discharged therefrom flows helically relative to the centerline and towards said flow outlet;

wherein said inner combustion liner comprises a converging cross-sectional shape from the forward inlet end of the inner combustion liner to the aftward outlet end of the inner combustion liner such that the converging cross-sectional shape of the inner combustion liner is convex, relative to the centerline, from the forward inlet end of the inner combustion liner to the aftward outlet end of the inner combustion liner, wherein said outer combustion liner comprises a converging cross-sectional shape from the forward inlet end of the outer combustion liner to the aftward outlet end of the outer combustion liner such that the converging cross-sectional shape of the outer combustion liner is convex, relative to the centerline, from the forward inlet end of the outer combustion liner to the aftward outlet end of the outer combustion liner;

wherein the cavity portion is defined at a radially outermost region of the combustor and wherein the flow inlet is defined at the respective forward inlet end of the inner combustion liner and the forward inlet end of the outer combustion liner.

10. The turbine engine in accordance with claim 9, wherein each film cooling hole of said plurality of film cooling holes comprises a flow channel that extends through said at least one of said inner combustion liner or said outer combustion liner at an oblique angle relative to a radial axis of the turbine engine, and wherein each flow channel is angled to channel the cooling airflow in an aftward axial direction relative to the centerline.

11. The turbine engine in accordance with claim 10, wherein said flow channel is angled in a circumferential direction relative to the centerline.

12. The turbine engine in accordance with claim 10, wherein said flow channel is angled in an axial direction relative to the centerline.

13. The turbine engine in accordance with claim 10, wherein said plurality of film cooling holes are formed such that the oblique angle of said flow channel relative to the radial axis is greater than 50 degrees.

14. The turbine engine in accordance with claim 9, wherein each cavity inlet hole of the plurality of cavity inlet holes comprises an elongated slot that extends axially relative to the centerline.

15. The turbine engine in accordance with claim 14, wherein said plurality of film cooling holes are configured to discharge the cooling airflow therefrom such that the predetermined angular momentum of the cavity airflow is maintained when the cooling airflow mixes with the cavity airflow.

16. The turbine engine in accordance with claim 14 further comprising a plurality of dilution holes formed in said inner combustion liner, said plurality of dilution holes configured such that dilution airflow discharged therefrom flows helically relative to the centerline, the dilution airflow discharged at a greater flow rate than a flow rate of the cooling airflow.

17. The turbine engine in accordance with claim 16, wherein said plurality of dilution holes are configured to discharge the dilution airflow therefrom such that the predetermined angular momentum of the cavity airflow is maintained when the dilution airflow mixes with the cavity airflow.

* * * * *